US007155864B1

(12) United States Patent
Din

(10) Patent No.: US 7,155,864 B1
(45) Date of Patent: Jan. 2, 2007

(54) LIQUID DISPERSING PLATE

(76) Inventor: Michael W. Din, 54 Edgewood Dr., Florham Park, NJ (US) 07932

( * ) Notice: Subject to any disclaimer, the term of this patent is extended or adjusted under 35 U.S.C. 154(b) by 16 days.

(21) Appl. No.: 10/402,405

(22) Filed: Mar. 31, 2003

(51) Int. Cl.
*E04D 13/00* (2006.01)

(52) U.S. Cl. ..... 52/11; 52/97; 248/48.2

(58) Field of Classification Search ..... 52/11, 52/12, 90.1, 90.2, 94, 97; 248/48.1, 48.2; 210/247, 474, 477, 499
See application file for complete search history.

(56) References Cited

U.S. PATENT DOCUMENTS 3,436,878 A * 4/1969 Singer ..... 52/12
3,939,616 A * 2/1976 Schapker ..... 52/94
4,389,351 A * 6/1983 O'Brien ..... 261/36.1
4,553,356 A * 11/1985 Pepper ..... 52/11
4,765,101 A * 8/1988 Wolf ..... 52/12
5,040,750 A * 8/1991 Brant ..... 248/48.2
5,271,192 A * 12/1993 Nothum et al. ..... 52/12
5,398,464 A * 3/1995 Jacobs ..... 52/12
5,619,825 A * 4/1997 Leroney et al. ..... 52/12
5,848,857 A * 12/1998 Killworth et al. ..... 405/118
6,128,865 A * 10/2000 Din ..... 52/94
6,598,352 B1 * 7/2003 Higginbotham ..... 52/12

* cited by examiner

*Primary Examiner*—A. Joseph Wujciak, III
(74) *Attorney, Agent, or Firm*—Armstrong, Kratz, Quintos, Hanson & Brooks, LLP

(57) ABSTRACT

A liquid dispersing device includes a relatively rigid thin perforated plate having a plurality of closely spaced minute openings or holes in the form of a fine mesh. A plurality of plates are mounted on brackets secured along a side wall of a structure in the path of liquid flowing over and downward from the upper end of the wall. The liquid passing through the holes is dispersed into fine droplets with minimum agglomeration. The angle of the plate and holes determine the direction in which the droplets are dispersed. Use of the perforated plates can eliminate the usual gutter and leader structures which remove rainwater from roofs of houses and can also provide more effective cooling when mounted along internal cooling tower walls.

14 Claims, 3 Drawing Sheets

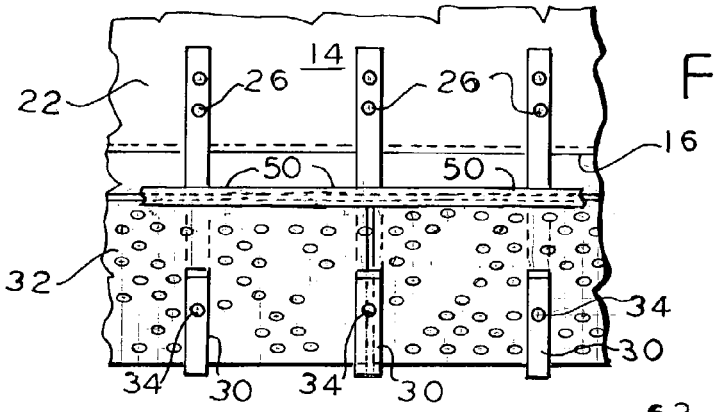
FIG. 9
FIG. 10
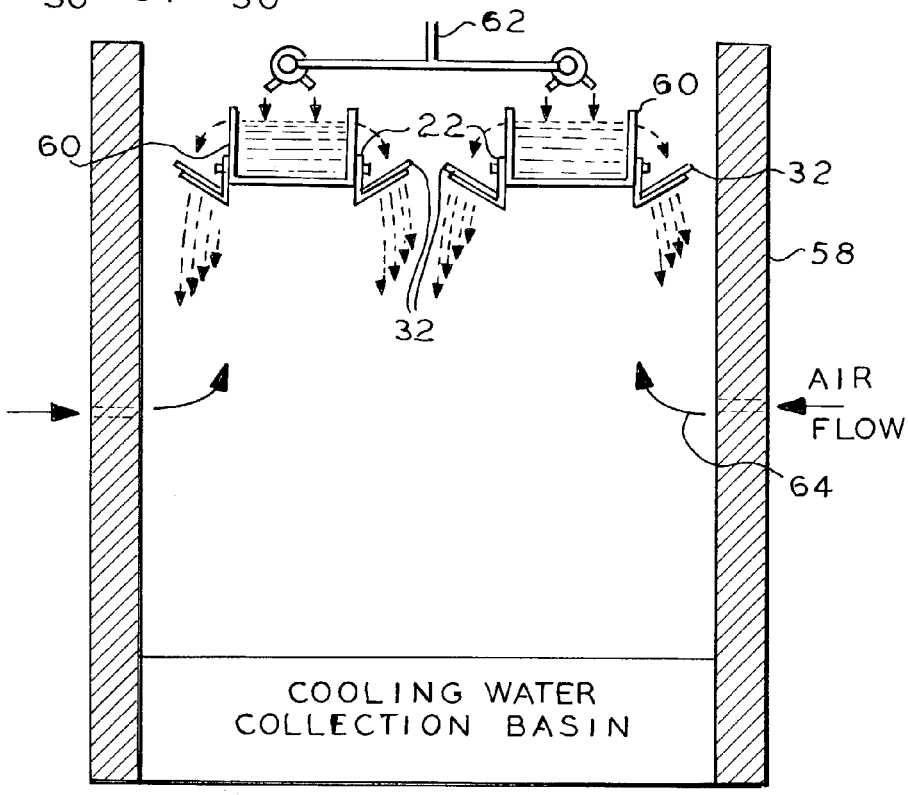
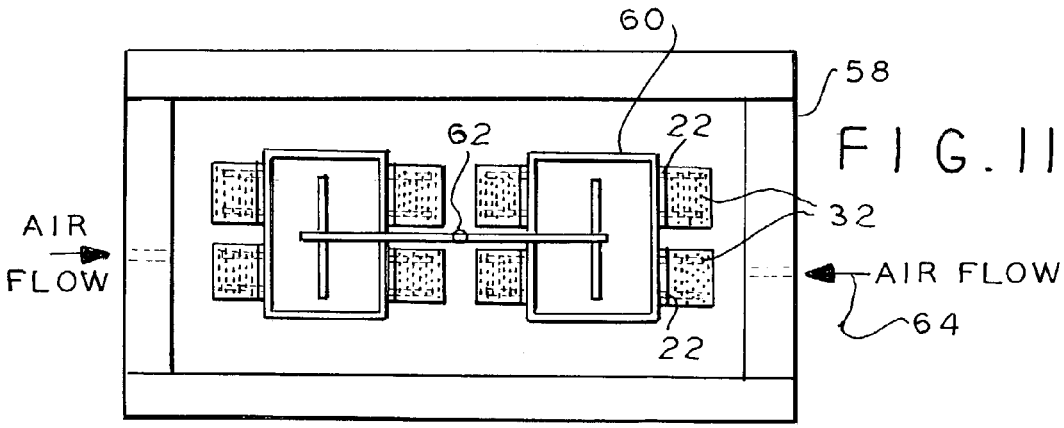
FIG. 11

LIQUID DISPERSING PLATE

BACKGROUND OF THE INVENTION

1. Field of the Invention

The present invention relates to devices for dispersing liquids in the form of rainwater runoff from roofs of houses or buildings, or water droplets as used in cooling towers. A unique relatively rigid thin perforated plate having a plurality of closely spaced minute openings in the form of a fine mesh reduces the size of liquid droplets and disperses the liquid through the openings while preventing agglomeration of larger volumes. Use of the perforated plate eliminates the usual gutter and leader structures which remove rainwater flow or can replace internal fill in cooling towers.

2. Description of the Prior Art

U.S. Pat. No. 3,939,616 to Schapker concerns a rainwater run-off disperser structure comprising deflector plates extending laterally at a small downward angle from a side wall of the building below the roof edge in the path of falling water. The deflector plates include a plurality of small openings with associated deflecting surfaces at larger downward angles which direct the rain water outwardly and downwardly from the roof Larger streams of rainwater are dispersed into separate sprays to avoid direct run off without the use of gutters.

U.S. Pat. No. 4,010,577 to Stalter is directed to a roof drain system employing a housing extending along the lower edge of a roof and having a multiplicity of small openings through which water can be dispersed. The housing forms an elongated air duct with high pressure air supplied by a motor driven blower to cause jets of air that force droplets of water through the openings to disperse the water over a large area. The usual water troughs and downspouts are eliminated.

U.S. Pat. No. 4,068,424 to Madfis utilizes angled deflector plates extending along and below the edge of the roof. The plates include a plurality of vertical baffles having spaced protrusions which impede and uniformly distribute the heavy flows of rainwater to disperse the rain in a random pattern of small droplets. The use of gutters is avoided.

U.S. Pat. No. 4,646,488 to Burns discloses a rain disperser system utilizing a plurality of parallel angled deflector plates supported on a base plate extending around the perimeter of the roof Spacer elements hold the deflector plates in a desired position.

U.S. Pat. No. 5,261,195, U.S. Pat. No. 5,261,196 and U.S. Pat. No. 5,579,611 to Buckenmaier et al disclose several variations of roof water dispersal systems utilizing deflector plates of different configurations running along a support structure around and below the perimeter of the roof Desired angular orientations of louvers and slats are maintained by cross-member spacers.

U.S. Pat. No. 6,128,865 to Din relates to a fine mesh screen mounted along a wall in the path of a flow of liquid to divide and split larger size liquid drops into much smaller droplets which are dispersed without agglomeration. A support structure holds the mesh screen in the path of rainwater below the edge of a roof to direct the droplets outwardly without the use of gutters or leaders.

While various forms of water droplet dispersing devices have been shown, these generally employ relatively complex structures which are less efficient in dispersing the liquid.

SUMMARY OF THE INVENTION

It is therefore the primary object of the present invention to provide an improved structure which reduces the size of large drops of liquid such as water into much smaller droplets which can be readily dispersed.

It is another object of the invention to employ a unique structure which splits larger drops to form very small droplets which are prevented from agglomerating.

An additional object of the invention is to provide a relatively rigid thin plate perforated with a mesh of fine openings which cause drops of water to be divided into much reduced sizes and minimize accumulation of residual liquid.

It is also an object of the invention to provide a perforated plate with a mesh of openings of smaller size than the impinging liquid droplets and of a thickness to further reduce the droplet size.

Yet another object of the invention is to provide a perforated plate with a mesh of openings which direct the flow of droplets in a desired direction away from the walls of the supporting structure.

A still further object of the invention is to mount the perforated plate at an angle to the supporting wall or to provide an angle to the openings in the plate which determine the direction of the dispersion of droplets and also prevent accumulation of debris resting on the surface.

Another object of the invention is to provide a mounting structure supporting the perforated plate at a desired position in relation to the adjacent wall.

An additional object of the invention is to provide a plurality of spaced mounting structures to support a plurality of juxtaposed perforated plates extending along and around the side walls of a building below the roof.

A further object of the invention is to eliminate the use of gutters and leaders, minimize accumulation of leaves and debris, simplify cleaning of the perforated plate structure, avoid water rotting of the adjacent walls, and reduce collection of ground water.

Another object of the present invention is to provide more efficient dispersion of liquid droplets in other structures such as a cooling tower to improve the cooling function.

These objects and advantages are achieved with a novel perforated mesh plate structure which, as used in a rainwater dispersing system, is mounted along the fascia below the roof.

A series of support angle brackets are mounted and spaced along the length of the fascia below the sloped ends of the roof and extend outwardly to hold a plurality of aligned juxtaposed perforated mesh plates in the path of rainwater falling from the roof. Each plate is secured to a bracket by screws or bolts and includes the mesh of fine openings which divides larger rain drops into much smaller droplets which can be dispersed with a minimum of agglomeration and directed away from the adjacent wall structure. The plate is positioned at a given distance below and extending outwardly from the roof edge so that the drops fall with sufficient momentum to pass through the mesh openings to be reduced to smaller droplets which are dispersed outwardly. The angle of the plate or the openings in the plate determine the direction in which the droplets are dispersed.

The perforated mesh plate may also be used in other structures such as cooling towers to reduce the size of water droplets. Other objects and advantages will become apparent from the following description in conjunction with the accompanying drawings.

BRIEF DESCRIPTION OF THE DRAWINGS

FIG. 4(*b*) is a plan view of the alternate support angle bracket.

FIG. 9 is a front sectional view of two adjoining mesh plates supported horizontally on spaced brackets along a length of wall with adjacent ends held in position by an additional common bracket and overlapping alignment strips extending along the outer edges.

FIG. 10 is a side sectional view schematically illustrating the use of mesh plates along cooling water channels in a cooling tower for dispersing water droplets.

FIG. 11 is a plan view of the cooling tower illustrating the use of the mesh plates along the cooling water channels.

DESCRIPTION OF THE PREFERRED EMBODIMENTS

The present invention represents an improvement over U.S. Pat. No. 6,128,865 to Din which is incorporated herein by reference.

Figure 1:
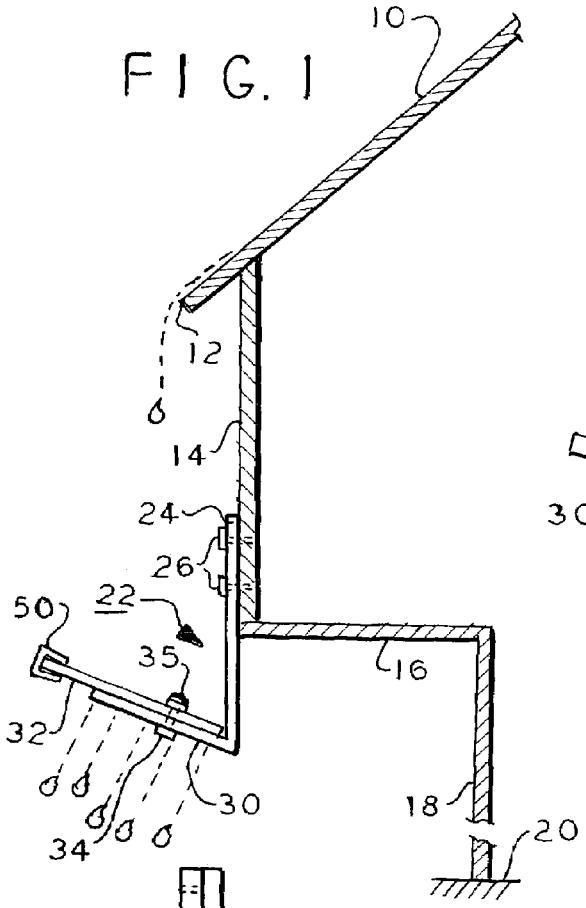
FIG. 1 is a side sectional view of a portion of a house showing the roof, fascia, and mesh plate and support structure mounted on the fascia below the roof.

As shown in FIG. 1, a side sectional portion of a typical house includes a slanted roof 10 having an edge 12 extending over a vertical fascia board or wall 14 below the roof edge. A horizontal overhang 16 is set back from the fascia to join the side of the house 18 which is supported on a foundation built into the ground 20. A typical L-shaped support angle bracket 22 includes a vertical portion 24 secured to the fascia by screws 26 passing through mounting holes 28 shown in further detail in FIGS. 2 and 3. A lower angled lateral portion 30 extends outwardly below the fascia and supports the relatively rigid thin mesh plate 32 perforated by a plurality of minute holes. A bolt 35, shown in FIG. 1, passes through one of the mounting holes 36 in the lower angled lateral portion 30 and hole 38 in the mesh plate 32, shown in FIG. 5. The bolt 35 with nut 34 secure plate 32 to the support bracket. The second outermost hole 36 in the lower bracket portion 30 permits the mesh plate 32 to be secured in a position further removed from the fascia wall 14 in cases where the roof edge 12 extends further outwardly. The mesh plate can then be in an extended position in the path of liquid falling from the roof.

Figure 2:
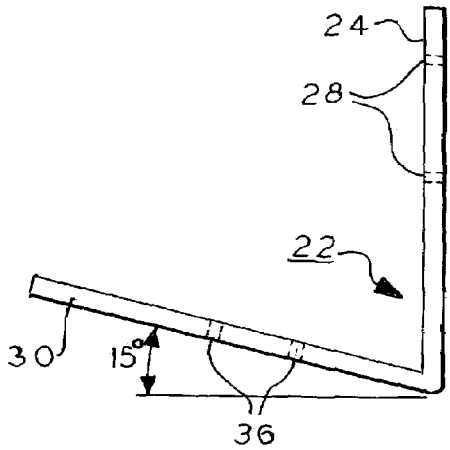
FIG. 2 is a side sectional view of a support angle bracket for mounting the mesh plate to the fascia wall.
Figure 3:
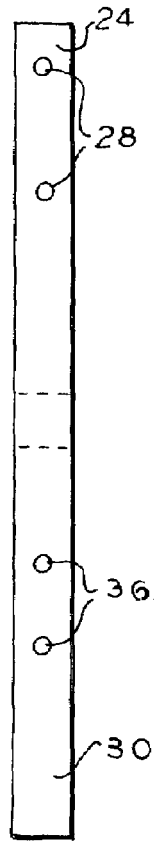
FIG. 3 is a front view of the support bracket in an unformed shape before bending to the angle as in FIG. 2.

FIG. 3 shows the support bracket as a narrow width, long thin straight plate in an unformed shape prior to having the lower portion 30 being bent to the angle as shown in FIG. 2. This angle may be at 15 to 30 degrees from the horizontal to hold the mesh plate at that angle or also may be held at a horizontal angle or angles there between depending upon the desired position of the mesh plate and the angle of holes in the plate, as further described in connection with FIGS. 6, 7 and 8.

Typical dimensions for the support brackets may be ⅜ inches in width, ⅛ inches in thickness, and 5½ inches in length, with the vertical portion about 2¾ inches and the outwardly extending lateral portion about 2¾ inches including the bend. The preferred material is an aluminum alloy.

Figure 4A:
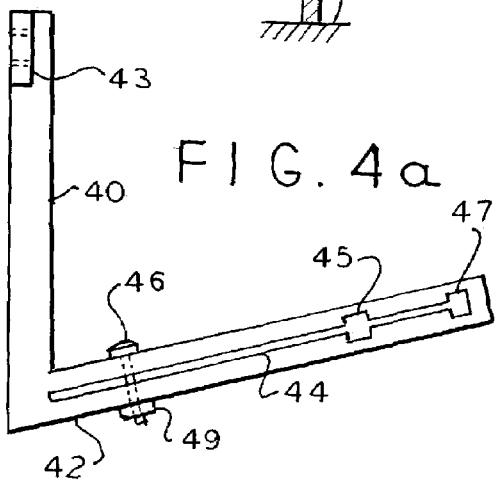
FIG. 4(*a*) is a side sectional view of an alternate support angle bracket having a slot to receive a mesh plate.
Figure 4B:
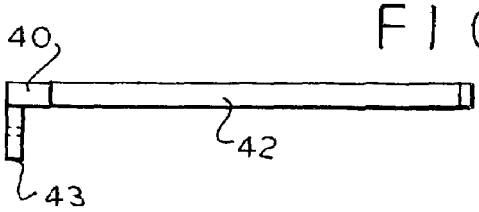

FIGS. 4(*a*) and (*b*) show an alternate support angle bracket 40 wherein the lower upward and outwardly extending lateral portion 42 includes a slot 44 passing therethrough and receiving the width of the thin mesh plate 32 which fits through the slot. A bolt 46 passes through hole in plate 32. The bolt and accompanying nut 49 more effectively secure the plate in position between brackets. The angle of the lower bracket portion may be varied as above to hold the outwardly extending mesh plate at a desired angle. An extension 43 on one side with screw holes secures the bracket to the fascia wall 14.

Figure 5:
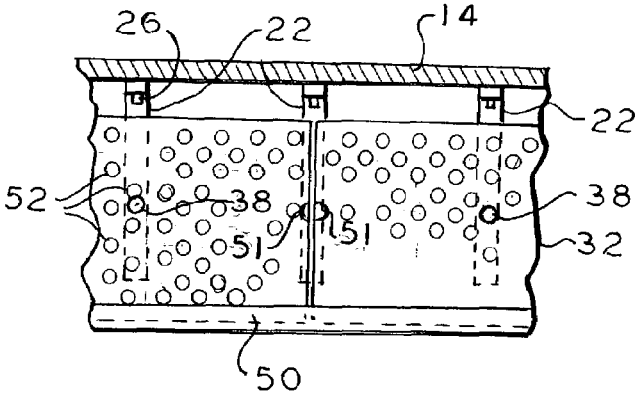
FIG. 5 is a plan view of a portion of two juxtaposed perforated mesh plates supported by three spaced angle brackets secured to the fascia wall.

As shown in FIGS. 5 and 9, a plurality of spaced brackets 22 support a plurality of mesh plates 32 extending horizontally along the length of and below the fascia wall 14. The adjacent side ends and outer edges of the juxtaposed mesh plates are held in a straight line by open wedge-shaped alignment clips or strips 50 which overlap the adjacent ends to maintain the mesh plates in the desired horizontal position along the wall. The adjacent plate edges are also held in place by a common shared bracket with the abutting edges including notches 51 for receiving bolts passing through the bracket holes and plate edges. The brackets at the edges minimize deformation. The strips shown in a side view in FIG. 1, are preferably thin and flexible to fit over the outer edges and may include colors to provide a decorative enhancement. The strip lengths may vary between 2 inches to fit only over the close ends or may run up to 5 feet along the entire length of the outwardly extending edges of the mesh plates. The enlarged portions 45, 47 of slot 44 in FIG. 4(*a*) are to receive the alignment strips 50 at the outer edges of the mesh plates in two different plate positions to accommodate a roof edge that extends further outwardly.

Typical dimensions for the mesh plate may be 1/16 inch or 0.0625, in thickness, 3 to 4 inches in width and 2½ to 5 feet in length. The brackets must be mounted along the walls so that the mesh plate width extends in the path of the liquid falling from the roof The brackets should be spaced sufficiently close along the length of each plate to maintain a desired horizontal linearity without buckling. Four brackets 10 inches apart maximize the supportable load. The minute hole dimensions may be about 1/16 inch, or 0.0625 in diameter, with 3/32 or 0.09375 inch spacing between centers of the holes in each row. The number of holes per inch may be between 10 and 11, or 125 per square inch. The center lines of adjacent alternate rows of holes along the length and width of the plate are offset or staggered and the total area removed by the holes should be maximized within manufacturing constraints, currently about 40 percent of the plate area, in order to maintain a required perforating rigidity. The number of holes per unit length and the thickness of the perforated plate determine the reduction in size of larger liquid drops into smaller droplets.

The holes should also be considerably smaller than a typical rain drop or drops of liquid directed from the slanted roof onto the mesh plate in order to effectively divide the larger drops into smaller droplets or spray to disperse the liquid without accumulation. The mesh plates should also be positioned at a minimum of 6 inches below the source of liquid to provide sufficient momentum to effect the dispersal into smaller droplets and to help prevent ice buildup.

Figure 6:
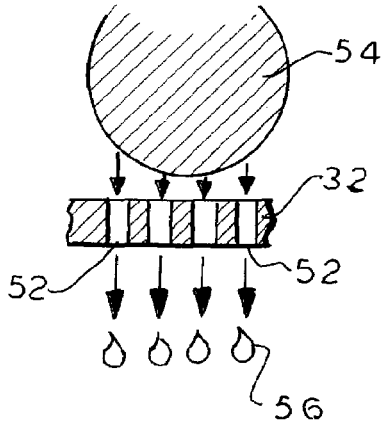
FIG. 6 is an enlarged side sectional view of a portion of a horizontally disposed thin solid mesh plate having minute holes or perforations perpendicular to the plate for dispersing larger rain drops into smaller droplets in a downward direction.
Figure 7:
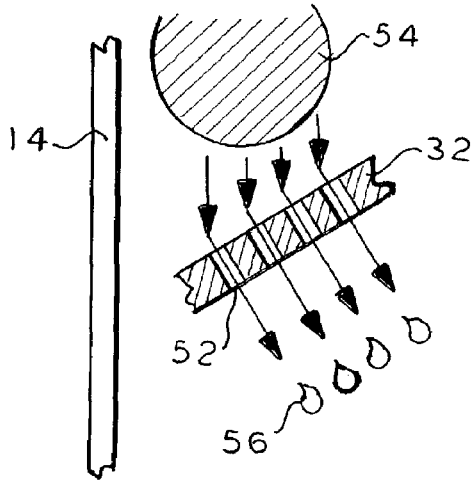
FIG. 7 is an enlarged side sectional view of a portion of a mesh plate disposed at an upward angle to the adjacent wall having holes perpendicular or orthogonal to the plate for dispersing droplets outwardly away from the wall.
Figure 8:
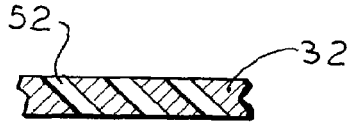
FIG. 8 is an enlarged side sectional view of a portion of a horizontally disposed mesh plate having holes at an outward angle for directing droplets away from the adjacent wall.

As shown in FIGS. 6, 7 and 8, enlarged side sectional views of portions of the mesh plate 32 having a plurality of minute holes 52, illustrate how a large liquid drop 54, upon striking the bridging between holes, is divided into smaller droplets 56 after passing through holes 52. A horizontally disposed plate with vertical holes as in FIG. 6, will direct the droplets downwardly in the vertical direction. FIG. 7 shows the mesh plate slanted at an upward angle from wall 14 with the perpendicular holes directing the droplets outwardly from the wall. The same effect may be achieved with a horizontally disposed mesh plate 32, as in FIG. 8, with the holes 52 positioned at the desired outward slanted angle to direct the droplets outwardly away from the wall. Various combinations of slanted mesh plates and slanted holes at different angles may be used to meet particular requirements. An added advantage of a slanted plate is in preventing undesired material or debris such as leaves from resting on the surface of the plate.

The present relatively rigid plate with minute holes passing through a particular thickness provides the holes with sharp edges which more effectively control the direction of droplet dispersion. The rounded edges of the more flexible screen type mesh, as described in U.S. Pat. No. 6,128,865, cause the droplets to be directed in the same downward direction as the downward slant of the plane of the screen. The plate type however normally disperses the liquid in the opposite downward direction thus requiring the plate to have an upward slant. In the slanted screen type, as liquid hits the upper round filaments the liquid flows down to the lower filaments. There are no hole sides to obstruct the flow and the droplets continue to fall in the same direction as the slant. The rigid plate type provides a more simple mechanical construction with fewer parts and easier assembly. The various materials can be similar, such as all non-rusting metal or plastic, except for bolting material which may be metal. The nuts are preferably of the locking type.

In an alternate embodiment, the mesh plate can be located at a minimum of 2 inches above the ground level directly below where the liquid would fall from the slanted roof to also disperse the liquid into small droplets. In this case the support brackets would have mountings driven into the ground to hold the mesh plate above ground level.

As shown in FIGS. 10 and 11, the mesh plate may also be utilized in a cooling tower 58 to reduce the size of water droplets and provide more effective cooling and heat transfer. The support brackets 22 mounted along the tower cooling water distribution channels 60 to hold the mesh plate 32 in the path of water falling from the channels. Water inlet piping 62 supplies warm cooling water to the cooling tower channels with water overflowing through slots to distribute water along the length of the channels onto the mesh plates. The slant of the plate and minute holes disperse the liquid into droplets directed into the center of the cooling tower. Air baffling along the walls directs air flow 64 upward into the cooling fluid to provide evaporative cooling of the dispersed droplets. The mesh plate supplies smaller diameter more uniform liquid droplets with more surface area per volume ratio to enhance the evaporative effects of the upward flowing air over the larger drops from the distribution system. This also enhances the liquid flow area over normal cooling tower fill used to enlarge the surface area exposed to the upward flowing cooling fluid. The droplets, however, are not small enough so that the dispersed liquid droplets will be entrained by the upward flowing cooling fluid.

While only a limited number of embodiments have been illustrated and described, other variations may be made in the particular configuration without departing from the scope of the invention as set forth in the appended claims.

What is claimed is:

1. A liquid dispersing system disposed along a side wall of a structure, comprising: a source of liquid flowing downward from an upper end of said wall, a plurality of brackets mounted at spaced intervals along said wall below said upper end, said brackets including vertical portions secured to said wall and lateral portions extending outwardly from said wall, and a thin relatively rigid perforated plate having a plurality of closely spaced minute holes extending along and across said plate and passing through said plate, said plate being secured to said outwardly extending lateral portions and extending outwardly from said wall in the path of said liquid flowing downward from said upper wall end, said holes being substantially smaller than substantially larger drops of said liquid impinging on said plate, said holes passing said liquid therethrough and dividing and dispersing said liquid drops into smaller droplets, said plate and brackets extending outwardly from said wall at an angle and said holes passing through said plate at an angle with respect to said plate, wherein the angle of said plate and the angle of said holes therethrough determine the direction in which said droplets are dispersed, and the dimensions of each of said holes along and across said plate are of substantially the same order of magnitude as the thickness of said plate wherein said brackets include a slot passing through said outwardly extending lateral portions for receiving the width and thickness of said plate, wherein said slot extends in longitudinal direction of outwardly extending lateral portions having length that extends from adjacent the bottom end of vertical portions to adjacent the free end outwardly from the wall.

2. The liquid dispersing system of claim 1 wherein said outwardly extending bracket portions and said plate are disposed at an upward angle with respect to said wall, and said holes in said plate are perpendicular with respect to said plate for directing liquid droplets away from said wall.

3. The liquid dispersing system of claim 1 wherein said outwardly extending bracket portions and said plate are disposed horizontally with respect to said wall, and said holes in said plate are at an outward angle for directing liquid droplets away from said wall.

4. The liquid dispersing system of claim 1 wherein said outwardly extending bracket portions are disposed horizontally with respect to said wall, and said holes in said plate are perpendicular to said plate for directing liquid droplets in a downward direction.

5. The liquid dispersing system of claim 1 wherein said slot includes enlarged portions therealong for receiving alignment strips at the outer edges of said plate and permitting adjustment of the position of said plate along said bracket portion.

6. The liquid dispersing system of claim 1 wherein said holes are disposed in aligned linear rows extending along and across said plate, said holes being spaced uniformly along each said row, for maximizing hole area and for maintenance of plate rigidity.

7. The liquid dispersing system of claim 6 wherein the plurality of holes per unit length and thickness of said plate determine the reduction in size of larger liquid drops into smaller droplets, and said holes are of substantially uniform size and shape.

8. The liquid dispersing system of claim 6 wherein said holes in said plate are approximately 0.0625 inches in diameter with spacing of 0.09375 inches between centers and the thickness of said plate is approximately 0.0625 inches.

9. The liquid dispersing system of claim 8 wherein the number of holes per unit area is approximately 125 per square inch.

10. The liquid dispersing system of claim 6 wherein the width of said plate is from 3 to 4 inches extending outwardly from said wall and said width extends beyond said outwardly extending bracket portions.

11. The liquid dispersing system of claim 10 wherein the length of said plate is approximately 2½ to 5 feet.

12. The liquid dispersing system of claim 1 wherein said plates are disposed at a minimum of six inches below said source of liquid to provide sufficient momentum to effectuate dispersal into droplets.

13. The liquid dispersing system of claim 1 wherein a plurality of said perforated plates are juxtaposed end to end extending along said wall secured to said brackets and said structure is a house having a sloping roof, said liquid is rain, said wall is a fascia below said roof, said lateral bracket portions extending outwardly below said fascia, said plates being disposed on said lateral bracket portions in the path of rain drops flowing from said roof, said plates dispersing said rain drops into smaller droplets.

14. The liquid dispersing system of claim 1 wherein a plurality of said perforated plates are juxtaposed end to end extending along said wall secured to said brackets and said structure is a cooling tower, said tower including a source of warm cooling water, and cooling water channels receiving said warm cooling water, said brackets and plates being secured along side walls of said channels, warm cooling water from said channels overflowing along said side walls on to said plates, the holes in said plates dispersing water passing therethrough into droplets for enhanced cooling.

* * * * *